United States Patent [19]

Forthmann

[11] Patent Number: 4,823,660

[45] Date of Patent: Apr. 25, 1989

[54] LABEL CUTTING DEVICE AND METHOD

[76] Inventor: Frederick Forthmann, 688 Pascack Rd., Washington Township, Old Tappan County, N.J. 07675

[21] Appl. No.: 831,930

[22] Filed: Feb. 20, 1986

[51] Int. Cl.[4] ..... B26D 7/10

[52] U.S. Cl. ..... 83/123; 83/15; 83/371; 83/572; 83/658; 83/171

[58] Field of Search ..... 83/123, 15, 16, 171, 83/658, 371, 571, 572

[56] References Cited

U.S. PATENT DOCUMENTS 3,623,209 11/1971 Zuhlke et al. ..... 83/16 X 3,732,770 5/1973 Ottavan ..... 83/658 X

*Primary Examiner*—Donald R. Schran

*Attorney, Agent, or Firm*—McGlew & Tuttle

[57] ABSTRACT

A device and method for cutting labels from a strip of heat meltable material comprises a frame, a die plate mounted for resilient movement on the frame and a punch mounted for movement toward and away from the die plate. The punch carries a cutting edge which cooperates with a die surface of the die plate to cut a label. A reciprocating device includes a spring loaded plunger which moves the die plate with its cutting edge into contact with the die surface of the die plate. The die plate is spring mounted to the frame so that excess movement of the punch toward the die plate is absorbed by the springs of the die plate. Any additional excess movement is absorbed by the spring loaded plunger. The die plate may also be provided with a hole conforming substantially to the outer contour of the label. The edge follows the contour of the hole but it is dimensioned slightly larger than the hole so that a margin of die surface remains around the hole against which the cutting edge operates. A slight radius is cut at the edge of the hole in the die plate. In this way when labels which were cut out by the cutting edge are pushed through the hole in the die plate, they do not leave residues of heat meltable material at the edge of the hole. The cutting edge of the punch is heated to facilitate cutting of the heat meltable material and to render the edges to be fray proof and heat sealed to prevent fraying of edges in wearing and washing with three types of seals, soft, medium and heavy. When the device is deactivated, a retracting mechanism lifts the punch with its heater away from the die plate. This avoids overheating the heatable material which may still be in the vicinity of the die plate.

6 Claims, 5 Drawing Sheets

LABEL CUTTING DEVICE AND METHOD

FIELD AND BACKGROUND OF THE INVENTION

The present invention relates in general to label making equipment, and in particular to a new and useful device and method for cutting labels from a strip of heat meltable material.

At the present time, labels such as those appearing in clothing or similar articles are generally manufactured of thermoplastic threads such as polyester threads and the like. Such labels may be sewn or heat sealed to clothing. If the labels are to be heat sealed to clothing, they may include a backing layer of thermoplastic.

Labels are also known which have a back layer of pressure sensitive adhesive. These labels are generally supplied on a strip of paper or other release material from which the labels can be removed for use.

In cutting the labels from the strip of heat meltable material, care must be taken to insure a complete severing of the label from the material. The position at which each cut is made is also critical since each label will carry a pattern that must be correctly centered in the label. Special attention is also necessary when cutting labels of white material since the heat used in the cutting operation may darken the margins of these labels.

When pressure adhesive labels are to be manufactured, care must be taken that only the labels are cut and that the paper strip carrying the labels remains substantially undamaged.

SUMMARY OF THE INVENTION

The present invention concerns a label cutting device which includes a die plate having a die surface. A punch carrying a cutting edge is reciprocated into engagement with the die surface. Heating means are provided at the punch for heating the edge so that with a strip of heat meltable material on the die plate a label can be cut from the material by pressing the cutting edge into engagement with the die surface.

In accordance with the invention, biasing means are provided between the die plate and the punch for compensating excess movement of the punch towards the die plate. The die plate may, for example, be spring mounted so that with the cutting edge engaged with the die surface and the punch moved further toward the die plate, the die plate retracts against its springs. This reduces wear on the cutting edge and at the same time insures a complete severing of the label from the heat meltable material.

Reciprocating means are used to reciprocate the punch toward and away from the die plate. Reciprocating means may also include a spring loaded plunger for pressing the punch into engagement with the die plate so that if the movement of the die plate against its springs are insufficient to compensate all the movement of the reciprocating means, the plunger may retract against its spring.

The punch is mounted on a heating plate for heating the cutting edge. When the device is deactivated, retracting means are used to lift the punch with its heating plate away from the die plate. This avoids heat damage to the label material lying on where labels having a closed outer contour are to be cut, the die plate and punch and provided with openings which substantially conform to the outer contour of the labels. The opening of the punch is slightly smaller than the opening of the die, so that a margin area is created on which the cutting edge engages. It is generally advantageous to provide a margin area of about 0.020 to 0.040 inches. A label pusher is also mounted on the device for pushing a label, once it has been cut from its heat meltable material through the opening in the die plate. The die plate is provided with a rounded edge around the opening rather than a sharp edge so that heat meltable material does not accumulate in the margin area of the die plate. This has been found particularly useful when labels are to be cut from white material.

The device also includes a support plate for the die plate and a support plate for the punch which are adjustable in mutually perpendicular directions. This permits accurate centering of the die plate hole with respect to the punch hole.

A feed table is also provided for aligning the strip of heat meltable material as it is fed toward the die plate. The table may be pivoted about an axis for steering the strip of material toward the die plate. The feed table may also be displaced laterally of the feeding direction for the strip. This aids in centering the patterns on the strip of material with the label that it is to be ultimately cut from the material.

It has also been found useful to make the punch and cutting edge of hard tool steel while making the die plate of softer metal. The useful life of the punch is thus increased. The cutting edge of the punch may also be either sharp or dull. Sharp cutting edges are used when labels are to be cut from the material and pushed through an opening in the die plate. When labels carrying a pressure adhesive on their back are to be cut from a strip of material while retaining the labels on a strip of support paper, the outer periphery of each label must be cut but the supporting paper must not be cut.

Accordingly, an object of the present invention is to provide a device for cutting labels from a strip of heat meltable material which comprises a frame, a die plate connected to the frame and having a die surface, a punch mounted for movement on the frame in a direction to and from the die plate, the punch having a cutting edge for cutting a label from the heat meltable material, heating means connected to the punch for heating the cutting edge, reciprocating means connected to the punch for reciprocating the punch to and from the plate and for pressing the cutting edge in engagement with the plate, and biasing means operatively connected between the punch and die plate for permitting retraction of at least one of the die plates and punch with respect to movement of the punch in a direction toward the die plate while the cutting edge is in engagement with the die surface.

A further object of the invention is to provide a device for cutting labels having different backings and supplied different configurations without damaging the labels.

A still further object of the invention is to provide a method of cutting labels from heat meltable material.

A still further object of the invention is to provide a device for cutting labels from a strip of heat meltable material which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
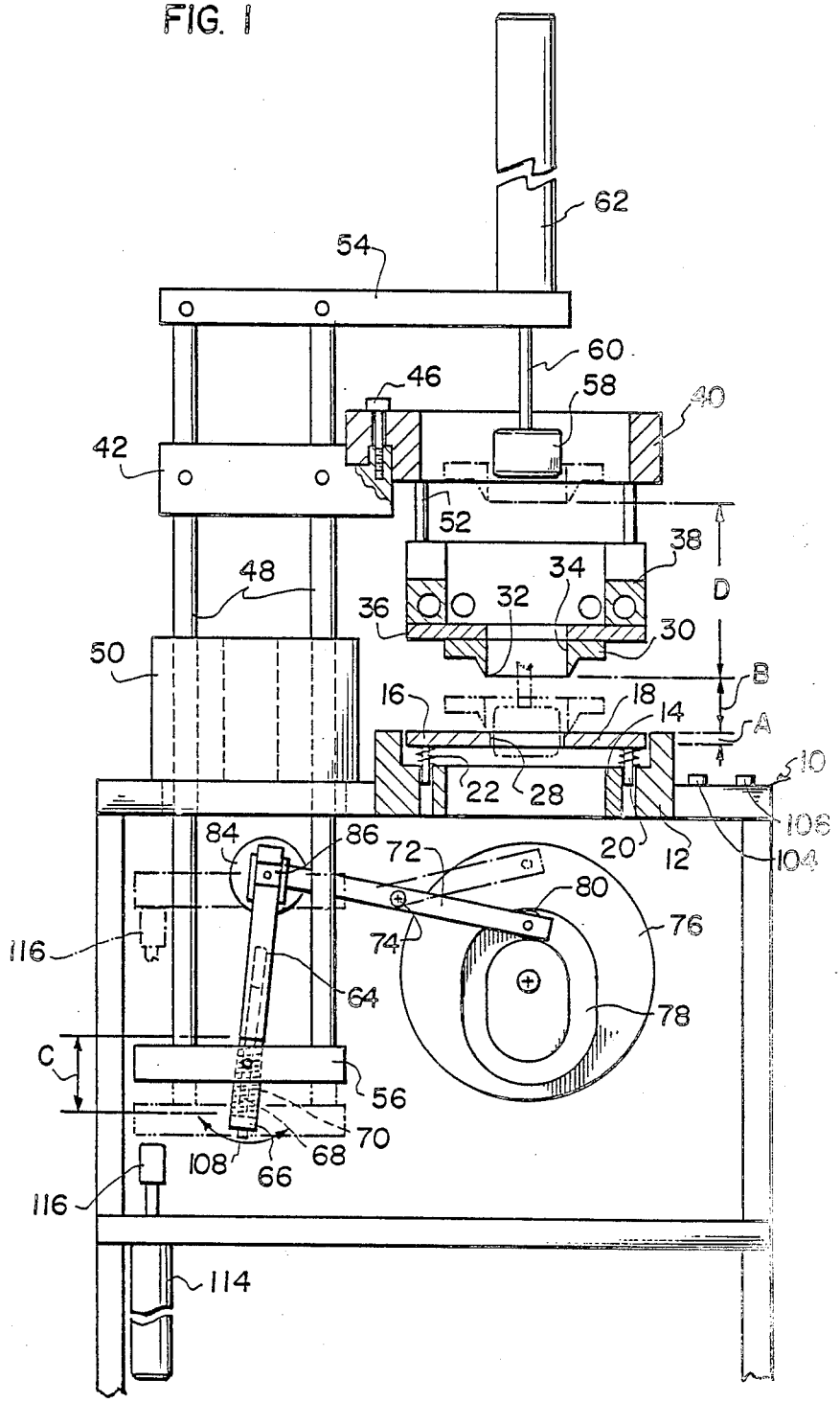
FIG. 1 is a front elevational view, partly in section, of a device for cutting labels in accordance with the present invention.
Figure 2:
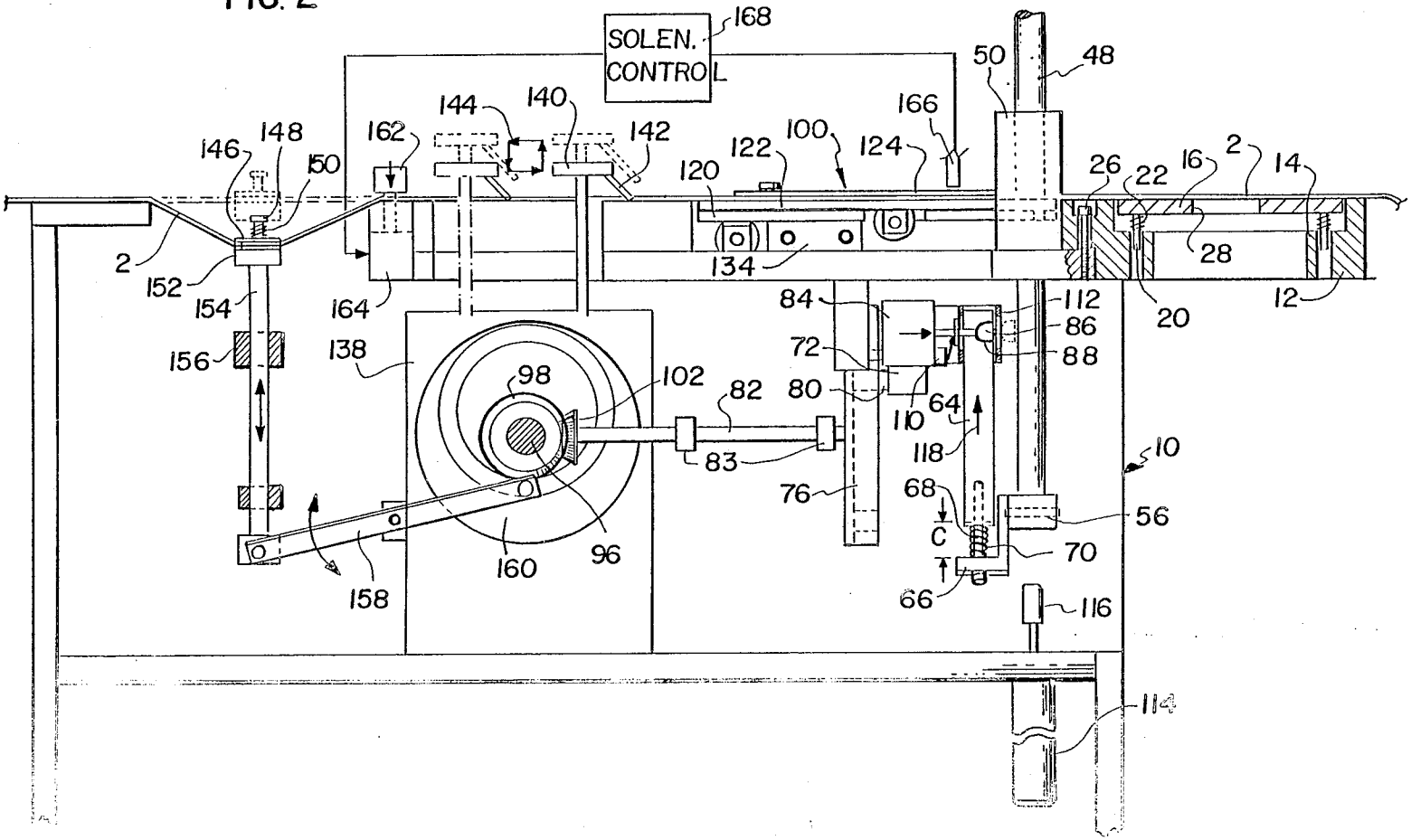
FIG. 2 is a side elevational view, partly in section, of the device of FIG. 1.
Figure 3:
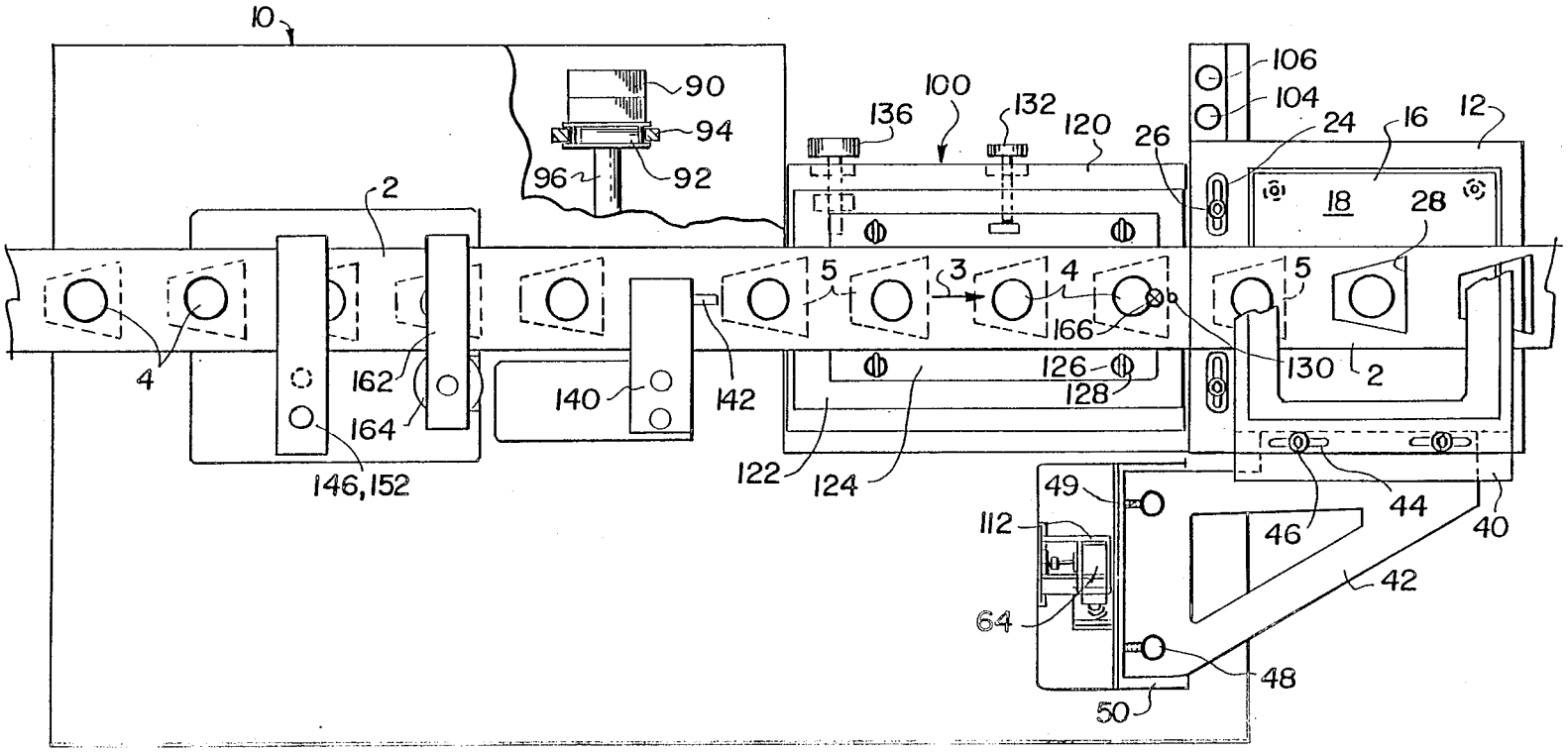
FIG. 3 is a top plan view, with portions cut away, of the device in FIG. 2.

Referring to the drawings in particular, the invention embodied in FIGS. 1, 2 and 3, comprises a device for cutting labels from a strip of heat meltable material.

The device includes a fixed frame generally designated 10 which carries a die plate support 12. As best shown in FIG. 3, plate support 12 has a pair of elongated slots 24 which each receive a bolt 26 which is threaded into the frame 10. This permits adjustment to the lateral position of plate support 12 with respect to a feed direction 3 for the strip of heat meltable material 2.

Die plate support 12 has a rectangular recess 14 which receives a movably mounted die plate 16. Four guide pins 20 extend downwardly from die plate 16 and into holes provided in plate support 12. Springs 22 are engaged around pins 20 and produce a resilient mounting for die plate 16. The length of pins 20 and slides of recess 14 are selected to permit a small retraction stroke of about 1/16th to ⅛th of an inch for plate 16. This is shown at A in FIG. 1.

Die plate 16 is also provided with a hole 28 which substantially corresponds in outer contour to the outline of a label to be cut from strip 2. As will be explained later, if labels having pressure adhesive backing are to be cut from a strip of fabric but retained on a supporting strip of paper or the like, die plates having no hole therethrough are utilized.

Die plate 16 has a die surface 18 against which a cutting edge 32 of a punch 30 is pressed. As best shown in FIG. 1; punch 30 is carried by a mounting plate 36 which in turn is carried by a heating element retainer unit 38. Interconnection of punch 30, plate 36 and unit 38 are accomplished using screws.

Retainer unit 38 is mounted over threaded connecting rods 52, to an adjustable support unit or plate 40.

The cutting edge 32 of punch 30 has an outer contour corresponding exactly to the label outline shown in 5 in FIG. 3, and thus to the outline of a label that is to be cut from the strip 2. For this purpose, punch 30 has a hole 34 therethrough which defines the cutting edge 32. Mounting plate 36 has a corresponding hole. Units 38 and 40 have larger central openings for the passage of a plunger 58 as will be described later. The openings in units 38 and 40 are much larger than hole 34 so that the same units can be used to mount different punches.

Adjustable support unit 40 is mounted on reciprocating support plate 42. Support unit 40 has elongated slots 44 which receive bolts 46 that are threaded into support plate 42. As shown in FIG. 3, this permits adjustment of support unit in a direction parallel to the feed direction 3. In this way, the hole 34 in punch 30 can be aligned exactly with the hole 28 of die plate 16.

Reciprocating support plate 42 is fixed to a pair of guide rods 48 using set screws. Guide rods 48 are mounted for sliding in a linear bearing 50 which is fixed to frame 10. A top cross beam 54 is fixed across the top of rods 48 and a bottom cross beam 56 is fixed across the bottom portion of rods 48.

A plunger cylinder 62 is connected to top cross beam 54. When supplied with air, cylinder 62 moves its piston rod 60 downwardly to lower plunger 58 connected to the end of piston rod 60.

Bottom cross beam 56 carries a pivotably mounted swing bracket 66 which is mounted for movement in the direction of curved double arrow 108. As shown in FIG. 2, bracket 66 is L-shaped. A threaded push rod 68 is fixed to swing bracket 66. A pusher member 64 has an opening in which pusher rod 68 is slidable. A pusher spring 70 is engaged around rod 68 and between pusher member 64 and swing bracket 66.

The top of pusher member 64 is operatively connected to a reciprocating lever 72 which is mounted for pivoting to frame 10 about pivot 74. One end of lever 72 carries a cam follower 80 which is in the form of a roller that is guided in a cam groove 78 of a cam disk 76. Cam disk 76 is fixed to a cam shaft 82 which is rotatably mounted by bearing 63 to frame 10.

By rotating cam disk 76, lever 72 is pivoted about its pivot 74 to move pusher member 64 downwardly and upwardly. This imparts a reciprocal upward and downward movement to the bracket 66 and the bottom cross beam 56. This in turn lowers and raises reciprocating support plate 62 which, through units or plates 40, 38 and 36, moves punch 30 in a reciprocating stroke shown at B in FIG. 1.

While the vertical position of support plate 42 on guide rods 48 can be adjusted, the device of the present invention can be used with label strips of different thickness. This is because die plate 16 is spring mounted on springs 22. The stroke B of punch 30 is selected to be slightly more than the usual maximum distance of punch 30 from die plate 16. In this way when punch 30 is lowered to its lowest position, it pushes die plate 16 downwardly. If this downward movement is more than the stroke A, spring 70 which is between pusher member 64 and bracket 66 is compressed up to its maximum stroke shown at C in FIG. 1.

The biasing means in the form of springs 22 and 70 also reduces the wear on punch 30, in particular at its cutting edge 32.

According to a preferred form of the invention, punch 30 is made of hardened tool steel with an outer chromium plating. Die plate 16 however, is made of softer steel. By making plate 16 softer than punch 30, punch 30 wears less.

During the normal cycling of punch 30 on its stroke B, the strip of heat meltable fabric 2 is fed in a stepwise manner in its feed direction 3. Since any single portion of the strip stays in the vicinity of punch 30 for only a short period of time, the heat from heating unit 38 does not detrimentally affect the stip. A controlled air flow (not shown) also cools the fabric. When the device is deactivated however, by pressing off button 106, measures must be taken to remove the source of heat from the area of the strip.

The inventive device is provided with an off button 106 which stops the reciprocal cycling of punch 30. At the same time, a lifting cylinder 114 is supplied with air which causes its lifting piston 116 to rise. Lifting piston 16 engages the bottom cross beam 56 and lifts the reciprocating assembly upwardly through the lifting stroke D shown in FIG. 1. This brings the punch 30 from its solid line position to its upper phantom line position, removing heat from heat sensitive material.

This lifting action cannot occur however, until the lever 72 is operatively disconnected from the pusher member 64. To accomplish this, lever 72 carries a disconnect cylinder 84. Diconnect cylinder 84 carries a piston and detent 86 which, when cylinder 84 is actuated, projects into a recess 88 of the pusher member 64. Upon pressing off button 106, cylinder 84 is deactivated, pushing piston and detent 86 in the direction of the arrow and out of recess 88. This permits pusher member 64 to slide upwardly in the direction of arrow 188 in a pusher slide 112 which is affixed to cylinder 84.

As soon as piston and detent 86 is retracted into recess 88, it engages a microswitch 110 which deactivates lifting cylinder 114. In this way the reciprocating assembly is not lifted until the drive means for the assembly is disconnected from pusher member 64.

Microswitch 110 or any other control element connected to button 106 is also operatively connected to the electric clutch 90 which disconnects pulley 92 from main shaft 96. Pulley 92 continues to rotate through its belt 94 which is connected to a main dc motor and gear box (not shown).

With the disconnection of main shaft 96, bevel gear 98 shown in FIG. 2 stops rotating. Bevel gear 98 is meshed with bevel gear 102 that is fixed to the end of cam shaft 82. Disconnection of electric clutch 90 thus stops rotation of cam disk 76 and thus stops reciprocating movement of the punch 30.

Pressing on button 104 activates electric clutch 90 to reconnect pulley 92 to shaft 96. Disconnect cylinder 84 is activated, returning detent 86 into recess 88 and the punch begins its reciprocating movement.

As shown in FIG. 3, the strip of heat meltable material 2 contains regularly spaced patterns 4 along its length. Each pattern is to be cut out on a label outline shown at 5 which may include part of the pattern or may have no pattern associated with it. As noted above, the outline 5 corresponds to the shape of cutting edge 32 on punch 30.

In order to bring successive patterns 4 into registry with the punch 30 and die plate 16, rectilinear feed means 138 are provided. Feed means 138 moves a carriage 140 in a rectangular pathway 144 shown in FIG. 2. Carriage 140 carries a finger 142 which, in the forward stroke of the carriage, moves the strip 2 a little more than spacing between two adjacent patterns 4. As will be explained later, alignment means are provided to pull the strip back against the feed direction 3 an exact amount to precisely align the pattern 3 with the punch and die plate.

The rectilinear means 138 may be driven by a disk cam or may be of any other appropriate type to move carriage 140. One example of rectilinear means 138 is a rectilinear driver manufactured and sold by the Stelron Cam Company of Saddle Brook, N.J. Another device of Stelron Cam Company which is capable of achieving necessary rectilinear motion is shown in U.S. Pat. No. 3,869,924 to Beezer.

The alignment means referred to above comprise a pull-back finger 146 which extends over strip 2. As best shown in FIGS. 2 and 3, pull-back finger 146 is mounted on an underplate 152 by a bolt 148. A spring 150 is engaged between the head of bolt 148 and the top of finger 146. Underplate 152 is connected to a guide rod 154 which rides in the direction of the double arrow in a linear bearing 156 fixed to frame 10. The lower end of guide rod 154 is pivotally mounted to the end of a pull-back lever 158 which has an opposite end with a cam follower guided in the cam groove of a pull-back cam disk 160. Disk 160 is fixed to main shaft 96 and thus rotates in synchronism with the up and down movement of the reciprocating assembly.

After push finger 142 on carriage 140 has pushed the strip 2 to its maximum extent in the feed direction 3, pull-down lever 158 pulls the underplate 152 down. Finger 146 thus pulls strip 2 down as shown in FIG. 2. This downward movement is in excess of what is actually needed to bring the pattern 4 on the strip 2 into its correctly aligned position between punch 30 and die plate 16. At some point during the downward movement of underplate 152, a solenoid 164 is actuated pulling a brake shoe 162 down. Brake shoe 162 cooperates with a platform segment on solenoid 164 to grasp strip 2. This prevents any further backward movement of strip 2. The moment in which solenoid 164 is operated is controlled by a solenoid control 162 which reacts to an impulse from a sensor 166. As shown in FIG. 3, sensor 166, which may be a known light barrier, is positioned at a transition or contrast border of pattern 4. The distance between a desired location for this border and the exact algined position for the pattern between the punch and die plate is known. In this way when sensor 166 senses the correct position of pattern 4 adjacent the sensor, the correct position for the pattern between the punch and die has also been established. At that instant sensor 166 sends a signal to solenoid control 168 which actuates solenoid 164 thus breaking the backward movement of strip 2. Finger 146 is spring loaded so that rod 158 can continue its downward movement without damaging the strip.

The label cutting device of the present invention also includes a guide table generally designated 100 which guides the strip 2 just before it is supplied over die plate 16. Table 100 comprises a stage 120 which is mounted for lateral movement on linear bearing 134 which is fixed to frame 10. This permits movement of stage 120 transversely of the feed direction 3. Stage 120 can be moved laterally by rotating translation wheel 136 which is journalled to the stage and which bears against a tab fixed on the frame. A return spring is used to urge a shaft of the translation wheel against the tab.

Stage 120 carries a guide plate 122 which is journalled at pivot point 130 to the stage 120. This permits rotation of guide plate 122 about pivot 130. A pivot wheel 132 is rotatably mounted to the stage 120 and bears against a tab connected to the guide plate 122 to provide this pivotal movement. A spring urges a shaft of the pivot wheel 132 against the tab.

By rotating wheels 132 and 136, the strip 120 can be steered exactly to its correct location between punch 30 and guide plate 116.

To accommodate strips having different widths, a pair of guide rails 124 is mounted on guide plate 122. Each guide rail has a pair of elongated slots 126 which receives a bolt with knob 128 which is threaded into the guide plate 122. By loosening bolts 128 the guides can be spread apart or brought together to correctly engage the edges of label strip 2.

Figure 4:
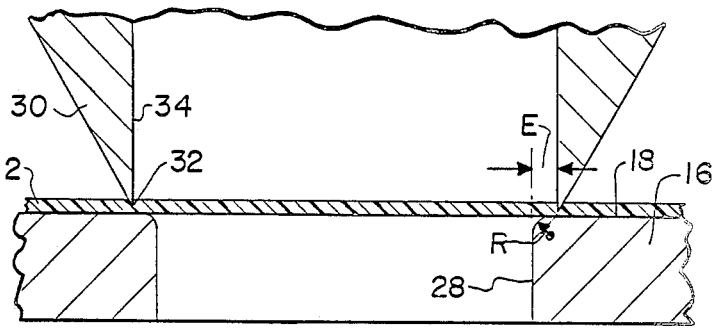
FIG. 4 is an enlarged partial detail of the punch and die plate.
Figure 5:
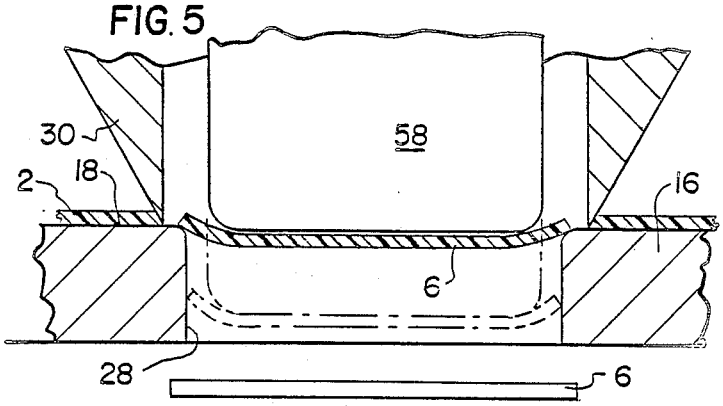
FIG. 5 is a view similar to FIG. 4 showing the interaction of a label with the die plate after it is cut.

Referring now to FIGS. 4 and 5, a specific relationship is established between the opening 28 in die plate 16 and the opening 34 in punch 30. According to the invention, opening 34 is slightly larger than opening 28 and defines a small clearance E between the cutting edge 32 and the edge of opening 28. Cutting edge 32 thus is brought down into engagement with the die surface 18 at a point spaced from the opening 28 in die plate 16. Clearance E is selected to be about 2 to 3 thousands of an in inch (0.020 to 0.030 in.). Where labels are to be cut from a strip of material but retained on a supporting strip of paper or the like, die plate 16 has no hole 28 and presents a continuous die surface 18 to the punch 30.

Where hole 28 is provided in the die plate 16, its edge adjacent die surface 18 is bevelled slightly and curved at a radius R. This has been found particularly advantageous in avoiding an accumulation of meltable material at the edge of hole 28. This avoids discoloring white material labels and also avoids the formation of unsightly beads at the edge of the labels.

FIG. 5 shows the action of plunger 58 when it is moved by its plunger cylinder 62 to extend the aligned holes of the punch and die plate. Label 6 which is cut from strip 2 has edges which smoothly slide over the bevelled edge of opening 28 as shown in FIG. 5. The phantom line position shows how the plunger 58 continues the movement of the label through the opening 28 until it is released below die plate 16. To prevent binding between the plunger 58 and the label 6, the plunger is dimensioned to be smaller than the opening 28 and establish a clearance F of about 1/16th of an inch with the opening 28. In this way the label can be bent slightly as it passes through the opening and then spring back into its planar configuration as shown in FIG. 5.

Figure 6:
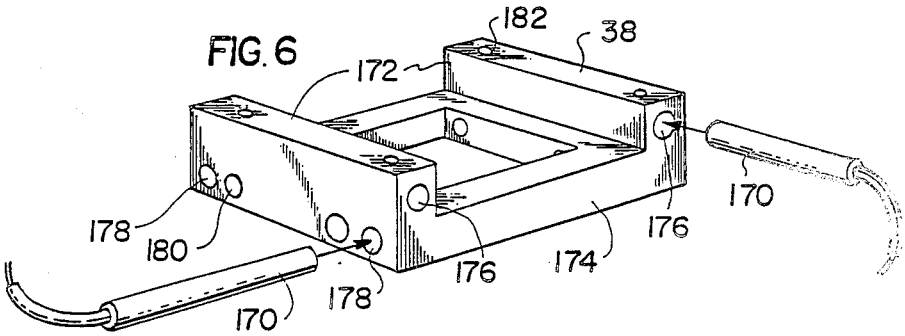
FIG. 6 is a perspective view showing a heating plate for heating the punch with different locations where heating elements can be introduced.

FIG. 6 shows a preferred form of the heating unit 38. Heating unit 38 has legs 172 extending upwardly from a web 174. Through holes 176 are provided in the legs 172. These can receive a heating element 170 of known design. If more intensive heat is desired, holes 178 extending through the web 174 may be provided with heating elements 170. In this case holes 176 are left empty.

If a smaller punch is to be mounted to the heating unit 38, an adaptor can be provided in the opening of heating unit 38 which has through openings aligned with openings 180. These openings can be provided with a heating element to bring the source of heat closer to the punch plate and thus minimize heating to the surroundings.

FIG. 6 also shows threaded holes 182 in the legs 172 which receive the threaded rods 52 for mounting the heating unit 38 to the adjustable support unit 40. This holds the support unit 40 away from the source of heat. The plunger 58 is also held up near the support unit 40 until it is actuated by its cylinder 42, to avoid heating the plunger.

Figure 7:
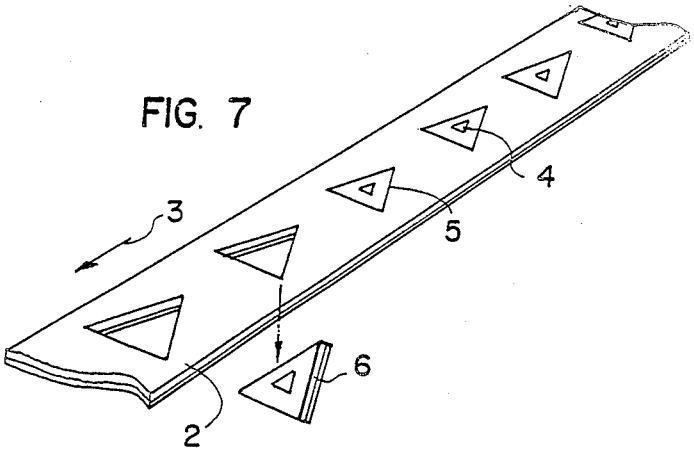
FIG. 7 is a perspective view showing a strip of heatable material from which labels can be cut.

FIG. 7 illustrates one type of meltable material strip 2 which can be used in accordance with the invention. A triangular label outline 5 is shown and one label 6 is shown as it is cut from strip 2. Strip 2 is fed in the direction 3 so that a pattern 4 is properly centered in each label 6. The material label 2 may be a woven or non-woven fabric of heat meltable threads, such as polyester or may be a continuous film of heat meltable material. Where a fabric is used, the fabric may include an undercoating of thermoplastic material so the labels 6 can be of the "iron-on" variety. The strip material may also have no backing and be simply sewn onto an article of clothing.

Figure 8:
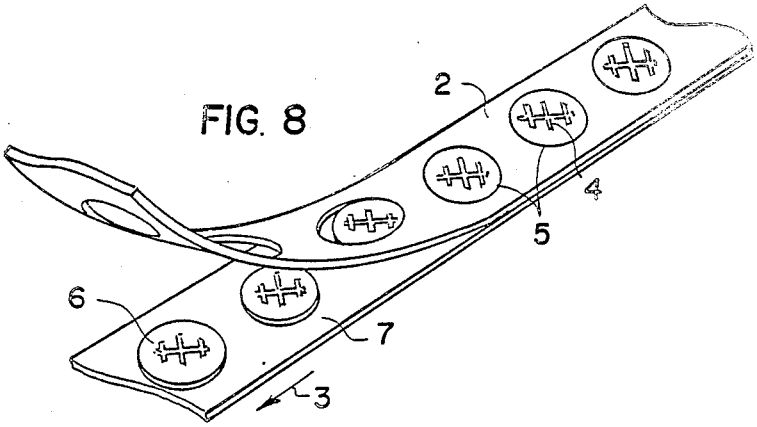
FIG. 8 is a view similar to FIG. 7 showing another type of material from which labels can be cut, the labels having adhesive backing and being retained on a support strip of paper or similar material.

FIG. 8 shows a type of label strip 2 which has an undercoating of pressure adhesive and which is mounted on a support strip 7. Support strip 7 may be of wax paper or other material having a release surface which is not permanently adhered to the pressure sensitive adhesive.

Each pattern 4 is cut out around the label border 5 and the strip 2 is peeled away from the strip 7 leaving labels 6 adhered to strip 7. This can be done in accordance with the invention by providing a die plate 16 which has no hole in it and by eliminating the plunger 58 and its cylinder 62. The rest of the device remains the same. To form the type of label configuration as shown in FIG. 8 is also desirable to slightly dull the cutting edge 32 of punch 30. This avoids cutting through the support strip 7. Support strip 7 should be resistant to heat so that only the heat meltable material 2 is cut.

When forming separate labels as in FIG. 7, the cutting edge 32 can be sharp.

While specific embodiments of the invention have been shown and described in detail to illustrate the application of the principles of the invention, it will be understood that the invention may be embodied otherwise without departing from such principles.

What is claimed is:

1. A device for cutting labels from a strip of heat meltable material comprising: a frame; a die plate connected to said frame and having a die surface; a punch mounted for movement on said frame and having a cutting edge for cutting labels; heating means connected to said punch for heating said cutting edge to melt the heat meltable material; reciprocating means operatively connected between said frame and said punch for reciprocal movement of said punch toward and away from said die plate for engaging said cutting edge with said die surface to cut labels from the heat meltable material; and biasing means operatively connected between said die plate and said punch for permitting retraction of at least one of said die plate and punch with respect to movement of said punch toward said die plate by said reciprocating means while said cutting edge is in engagement with said die surface, said reciprocating means comprising a reciprocating assembly mounted for movement to said frame and carrying said punch, said heating means including a heating unit connected to said reciprocating assembly adjacent said punch, and lifting means connected to said frame and operatively engageable with said reciprocating assembly to move said punch away from said die plate by a larger amount than during upward movement of said punch toward and away from said die plate, said lifting means comprising a cylinder connected to said frame having a piston engageable with said reciprocating assembly, said reciprocating means including a reciprocating lever movably mounted to said frame, a pusher member operatively connected to said reciprocating lever and engaged with said reciprocating assembly for pushing said reciprocating assembly and disconnect means operatively connecting said reciprocating lever to said pusher member and activatable to disengage said pusher member from said reciprocating lever so that said pusher member can move with said reciprocating assembly when said lifting cylinder is actuated.

2. A device for cutting labels from a strip of heat meltable material comprising: a frame; a die plate connected to said frame and having a die surface; a punch mounted for movement to said frame and having a cutting edge for cutting labels; heating means connected to said punch for heating said cutting edge to melt the heat meltable material; reciprocating means operatively connected between said frame and said punch for reciprocal movement of said punch toward and away from said plate for engaging said cutting edge with said die surface to cut labels from the heat meltable material; and lifting means operatively engageable with said reciprocating means for moving said punch away from said die plate by an amount greater than the reciprocating movement of said punch toward and away from said die plate to remove said heat means from the vicinity of said die plate, said reciprocating means comprising a reciprocating assembly movably mounted to said frame, a driving lever movably mounted to said frame and engaged with said reciprocating assembly for moving said reciprocating assembly, disconnect means connected between said lever and said reciprocating assembly for disconnecting said lever from said reciprocating assembly, a lifting cylinder connected to said frame and having a piston engageable with said reciprocating assembly for lifting said reciprocating assembly when said disconnect means is actuated to disconnect said lever from said reciprocating assembly, said punch being fixed to said reciprocating assembly and said heating means including a heating unit fixed between said punch and said reciprocating assembly.

3. A device according to claim 2, including feed means for feeding a strip of heat meltable material between said punch and die plate in a feed direction, an adjustable support plate connected to said reciprocating assembly at an adjustable position in said feed direction, said support plate carrying said heating unit.

4. A device according to claim 3, including a plunger movably mounted to said reciprocating assembly, said support plate, heating plate, punch and die plate having aligned openings through which said plunger is movable for pushing a label through said opening of said die plate.

5. A device according to claim 4, including a die plate support connected to said frame in an adjustable position transverse to said feed direction, said die plate being mounted to said die plate support, said die plate support and said support plate being adjustable for aligning their openings.

6. A device for cutting labels from a strip of heat meltable material comprising: a frame; a die plate connected to said frame and having a die surface; a punch mounted for movement to said frame and having a cutting edge for cutting labels; heating means connected to said punch for heating said cutting edge to melt the heat meltable material; reciprocating means operatively connected between said frame and said punch for reciprocal movement of said punch toward and away from said plate for engaging said cutting edge with said die surface to cut labels from the heat meltable material; and feed means for feeding a strip of heat meltable material carrying a repeating pattern thereon into a space between said punch and said die plate and by an amount greater than the spacing between patterns on the strip, with alignment means connected to said frame and operatively engageable with the strip for retracting the strip against its feed direction by a small amount, said alignment means including a pattern sensor for sensing a boundary of each pattern at a fixed location with respect to said frame and for retracting the strip up to the point where the boundary is sensed by said sensor.

* * * * *

UNITED STATES PATENT AND TRADEMARK OFFICE

CERTIFICATE OF CORRECTION

PATENT NO. : 4,823,660

DATED : April 25, 1989

INVENTOR(S) : Frederick Forthmann

It is certified that error appears in the above-identified patent and that said Letters Patent is hereby corrected as shown below:

On the title page, the following should be inserted after item [76]:

-- Item [73]: Assignee Stelron Components, Inc.
Mahwah, NJ --

Signed and Sealed this

Ninth Day of January, 1990

*Attest:*

JEFFREY M. SAMUELS

*Attesting Officer* *Acting Commissioner of Patents and Trademarks*